US006751899B2

(12) United States Patent
Cress et al.

(10) Patent No.: US 6,751,899 B2
(45) Date of Patent: Jun. 22, 2004

(54) MOLDED PLASTIC UNIBODY DISPLAY FRAME

(76) Inventors: Eric N. Cress, 545 S. Main St., Elburn, IL (US) 60119; Girard G. Phillips, 4326 Sheridan, Royal Oak, MI (US) 48073

( * ) Notice: Subject to any disclaimer, the term of this patent is extended or adjusted under 35 U.S.C. 154(b) by 130 days.

(21) Appl. No.: 10/101,919

(22) Filed: Mar. 20, 2002

(65) Prior Publication Data

US 2002/0133995 A1 Sep. 26, 2002

Related U.S. Application Data

(60) Provisional application No. 60/277,241, filed on Mar. 20, 2001.

(51) Int. Cl.[7] ..... A47G 1/16
(52) U.S. Cl. ..... 40/748; 40/756
(58) Field of Search ..... 40/748, 756, 781, 40/FOR 156, 765, 791, 711, 760; 248/469

(56) References Cited

U.S. PATENT DOCUMENTS 1,232,095 A * 7/1917 Sass ..... 40/756 X
2,448,580 A * 9/1948 Crosby ..... 40/748 X
3,570,160 A * 3/1971 Spertus ..... 40/765
3,837,987 A * 9/1974 Williams et al. ..... 40/756
4,041,630 A * 8/1977 Holbrook ..... 40/765
4,993,177 A * 2/1991 Hudson ..... 40/760 X
5,388,353 A * 2/1995 Givnan ..... 40/760 X
5,442,873 A * 8/1995 Vogler ..... 40/765 X
5,502,907 A * 4/1996 Wang ..... 40/711
5,524,370 A * 6/1996 Roy ..... 40/748

* cited by examiner

*Primary Examiner*—Joanne Silbermann
(74) *Attorney, Agent, or Firm*—Greer, Burns & Crain, Ltd.

(57) ABSTRACT

A molded unibody plastic display frame accepts and borders a photograph or similar media. The frame includes a media insertion slot and holds a picture, or other thin and flat media, with a traditional framing border around the media when it is inserted into the frame. Preferred features include an integral stand/and or hangers. Geometry of the preferred frame permits it to be formed in a single plastic mold injection. A preferred stand moves about a living hinge defined in a backing portion, and includes locking portions to lock it into a predetermined angle. Other optional features include interconnection structures such as male posts and female cups formed at frame edges.

25 Claims, 4 Drawing Sheets

B-B

C-C

MOLDED PLASTIC UNIBODY DISPLAY FRAME

PRIORITY CLAIM AND REFERENCE TO RELATED APPLICATION

This application is related to prior, co-pending provisional application serial No. 60/277,241 filed on Mar. 20, 2001. This application claims priority under 35 U.S.C. §119 from prior application Ser. No. 60/277,241.

FIELD OF THE INVENTION

A field of the invention is plastic display frames. Another field of the invention is plastic injection molding.

BACKGROUND OF THE INVENTION

The purchase of a display frame is based primarily upon appearance and price. A low cost plastic frame could provide an important market for impulse or ancillary purchases. There are a variety of discount stores, photo processing stores, and souvenir stores that could successfully market a plastic display frame having a pleasant appearance.

An example success has been an acrylic frame that traps a small photo between two clear acrylic surfaces. The surfaces are shaped to also form a stand. The entire frame is a single plane of material folded into a shape to form the stand and the two clear acrylic surfaces. Except at the point of folding, the frame is open on all sides. A photo is presented without a visual border to highlight a photo inserted into the frame.

SUMMARY OF THE INVENTION

A molded unibody plastic display frame formed from a single, contiguous piece of plastic accepts and borders a photograph or similar media. The frame includes a media insertion slot and holds a picture, or other thin and flat media, with a traditional framing border around the media when it is inserted into the frame. Preferred features include an integral hinged stand/and or hangers. A preferred stand and backing portion include locking portions to lock the stand into a predetermined free-standing display angle. Geometry of the preferred frame permits it to be formed in a single plastic mold injection. A variety of sizes, colors, and decorative features are possible to include in a frame of the invention.

DETAILED DESCRIPTION OF THE PREFERRED EMBODIMENTS

A display frame of the invention is formed from a single, contiguous piece of plastic. This allows the frame to be molded in a single step injection molding process. The frame geometry permits a traditional appearance, e.g., including a media border, despite its simplicity and low cost. Features such as a stand may be included, while the geometry of the frame of the invention has its shape, contour and size completely determined by contours of a mold used to form the frame. Various plastics and plastic colors are possible.

Figures 1A, 1B, 1C:
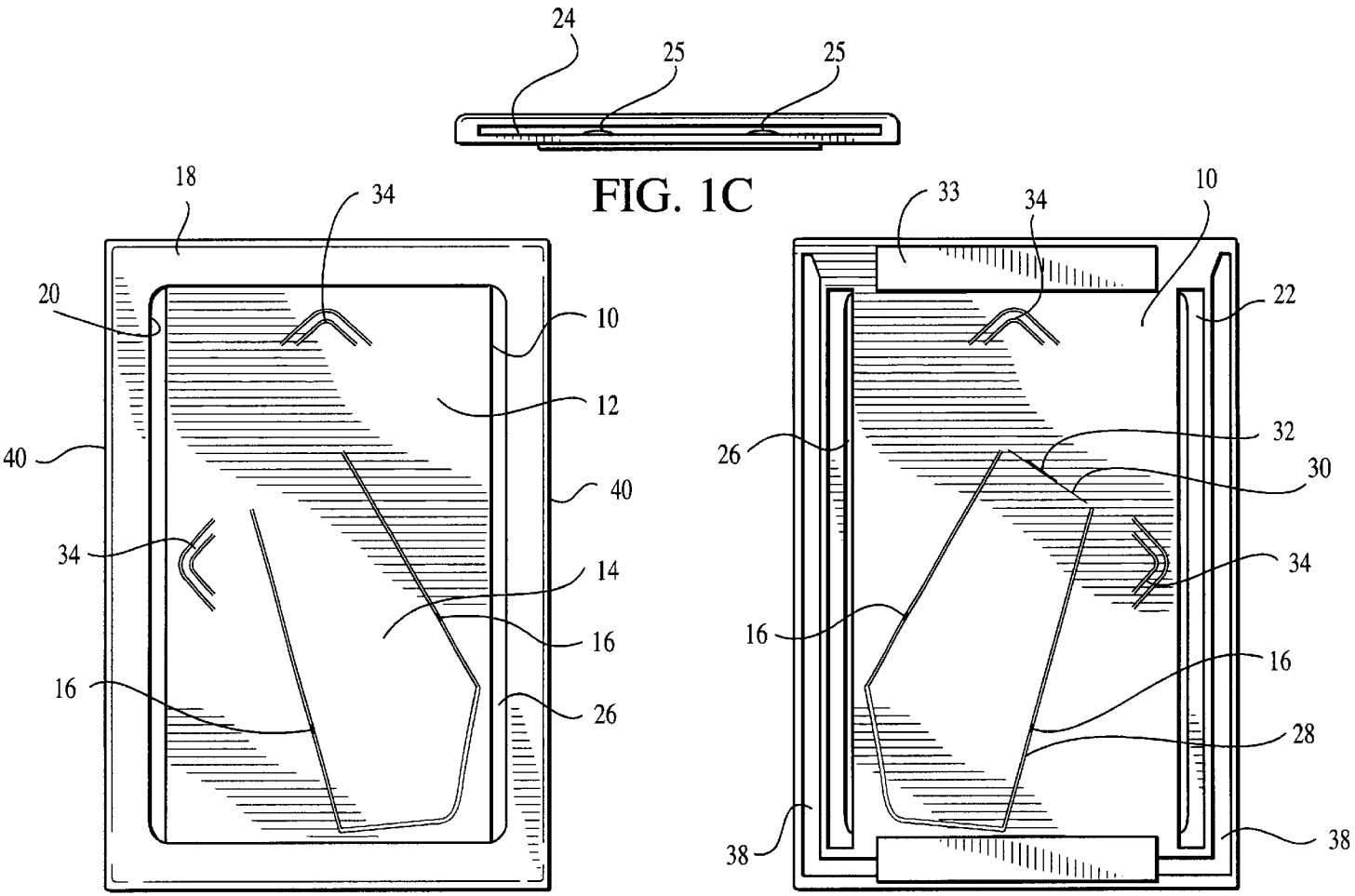
FIG. 1A is a front view of a preferred embodiment display frame.
FIG. 1B is a back view of the preferred embodiment display frame shown in FIG. 1A.
FIG. 1C is top view of the preferred embodiment display frame shown in FIGS. 1A and 1B.

A preferred embodiment display frame is shown in FIGS. 1A–1C, which are respective front, back and top views of a preferred embodiment display frame. A backing portion 10 includes a flat surface 12 (FIG. 1A) defined in a first plane. The flat surface 12 is flat over a substantial portion of its surface area, but may have a number of material gaps, holes, slots etc. This permits, for example, the formation of a preferred stand 14 defined within the backing portion. In the preferred embodiment, the stand 14 is held by thinned material retainers 16, which may be broken to permit the stand to be opened away from the backing portion 10. The overall size of the frame and backing portion may vary, and should be selected to hold a flat media of a predetermined size. As an example, the frame can be dimensioned to hold popular 4"×6" photographs.

When inserted, media of a predetermined size will also be held around its front edges by a framing portion 18. The framing portion 18 extends from the backing portion 10, but is turned back toward the backing portion 10 to define a media border 20. In other words, around edges of the frame, the backing portion 10 and framing portion 18 blend into each other. There is a gap between the surface 12 of the backing portion and a flat surface 22 of the framing portion that is in a second plane generally parallel to the plane of the surface 12. The gap forms channels 23 (see FIG. 3C) that accept edges of the media. The channel size is chosen to suit the preselected media. It may have a sufficient width for any essentially flat media, e.g., photos, invitations, instructions, awards, name plates, etc.

One of the frame sides lacks a channel, but includes an open slot 24. The open slot 24 is formed in the top of the exemplary embodiment, but may formed on another side (including the bottom side). The slot 24 is achieved by use of a cam and slide during the injection molding process. The cams move into place prior to injection of liquid resin, then move out of position prior to ejection of a formed frame from a mold. The backing portion 10 also includes openings 26.

The slot 24 accepts predetermined sized media, which may be slid into the frame through the slot or removed by sliding out through the slot 24. When a media of a predetermined size is slid in through the slot, it is retained in the channels 23 formed by the gap between the surface 12 and the surface 22. Preferably, there is also at least one crush rib 25 formed in the slot 24. In the preferred embodiment, two crush ribs 25 serve to maintain the slot spacing between the backing portion 10 and the framing portion 18. Within the border 20 is an open viewing area. The open viewing area defined by the border 20 permits viewing of at least a substantial portion of media. A customary quantity of the edge may be covered. As the frame may be formed from any number of plastics that may be colored to suit a preferred use, the border 20 frames media in a traditional manner. Preferably, the frame and border are sized to cover at least a portion of all four edges of a four-sided media, for example. This presents the traditional framing appearance.

As mentioned above, the backing portion 10 need not be a continuous flat surface. It may have holes and structures defined in it. There needs to remain material sufficient to provide structural integrity, however. The overall shape of the backing portion 10 and the framing portion 18 must provide structural support for the frame to maintain its shape and allow it to stand up or be hung or suspended.

In the preferred embodiment, the frame may be stood up in two free-standing orthogonal positions by the stand 14. A thumb depression 28 allows a person to grasp and gain leverage on the stand 14 to enable it to be pulled out for a first time use by breaking the low strength thinned material retaining portions 16. Once released, the stand 14 is movable to an angled position. It rotates about a living hinge 30, thin material permitting controlled deformation over a limited range. A ridge 32 or enlargement near the hinge 30 can act as a stop to define an end of the movement range for the stand. Tolerances around the stand 14 provide an interference type fit with the backing portion 10, allowing it to be stored back into a generally planar relationship with the backing portion 10. Other options are hook and loop, e.g., Velcro, adhesive, or magnet mounting aids 33, adhered to the frame after it is molded or during the molding process. Optional preferred hangers 34 are formed in a like fashion to the stand 14. The hangers 34 may be moved away from the backing portion 10 to permit hanging of the frame in two orthogonal positions. A perforation is another type of mounting aid 33 that may be formed in the backing portion 10 in an appropriate position, e.g. top center. Such a perforation or hole can accept a hook, a nail, or other similar object to permit the frame to be hung on a flat surface.

Figure 2:
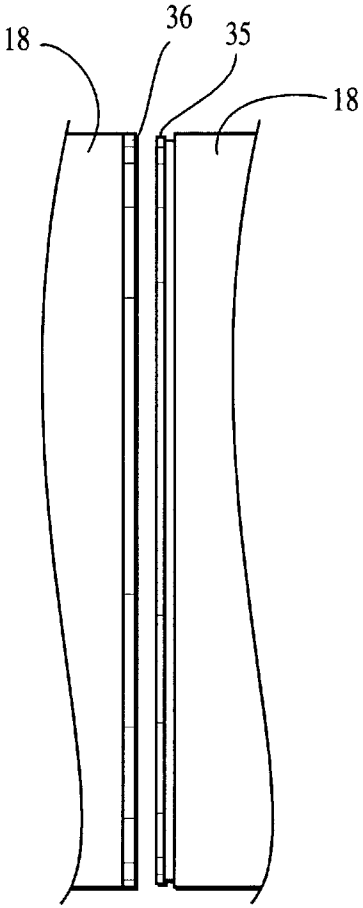
FIG. 2 shows partial view of an interlocking edge for two preferred embodiment display frames.

Outer edges of the frame may include interconnection structures. For example, as shown in FIG. 2, one side of the frame could include a male post 35 and the other a female cup 36. Such interconnection structures permit multiple frames to be interconnected to form fanciful displays including multiple frames. The interconnection structures can also facilitate mounting the frame into a holder, to form a frame album or mass storage unit.

Referring again to FIGS. 1A–1C, preferred features simplify the molding process and add structural integrity. There are uniform wall thickness openings 38. As will be appreciated by artisans, maintaining uniform wall thickness in a molded article will serve to maintain overall shape integrity. Warping is inhibited. The openings 38 prevent the framing portions from having a wall thickness exceeding that of other elements. The openings 26 permit a straightforward mold shape to form the channel between the backing portion 10 and the framing portion. Additionally, in the portion of a mold facing the front portion, a lifter inserted for forming the framing portion on an opposite end of the frame from the media insertion slot 24 is kept simple as it need not extend into corners. The openings 26 permit channels 23 in sides 40 to be formed from shapes on the opposite side of the mold.

The preferred embodiment of FIGS. 1A–1C has a simple stand 14. The stand 14 has a free range of movement, limited by material elasticity, and possibly a stop 32. When the stand 14 is used to free-stand the frame on a surface, the angle of free-standing may vary or be undesirable. Another embodiment is shown in FIGS. 3A–3E, that illustrate a frame of the invention having stand 42 including a preferred locking mechanism 44. In viewing FIGS. 3A–3E, like reference numerals have been used for portions of the FIGS. 3A–3E frame that are like those used in the FIGS. 1A–1C embodiment.

Figure 3A:
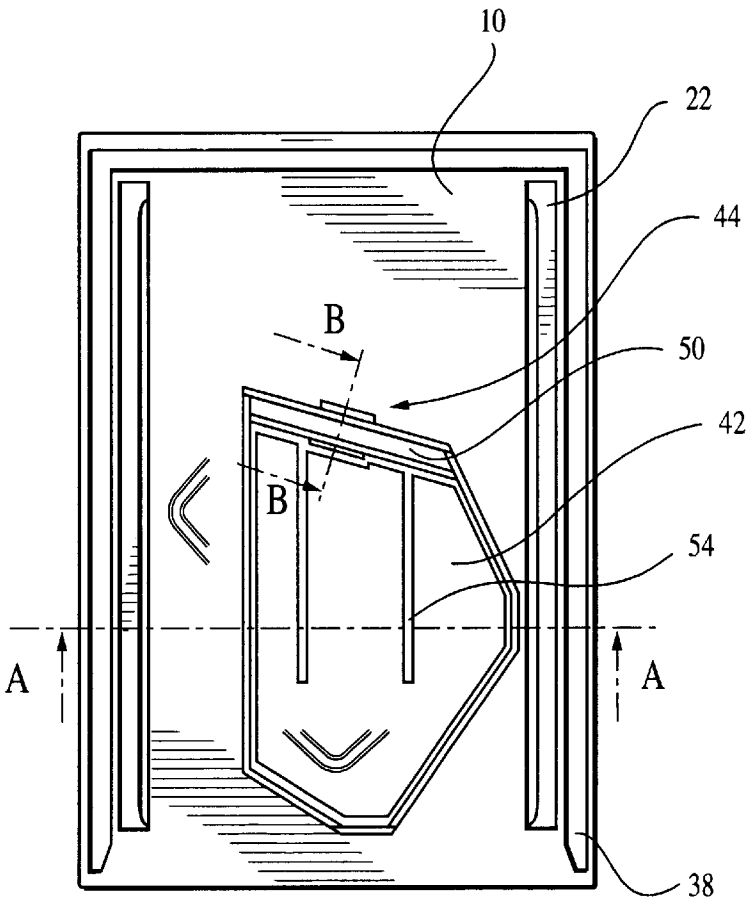
FIG. 3A is a back view of an alternate preferred embodiment display frame.
Figure 3C:
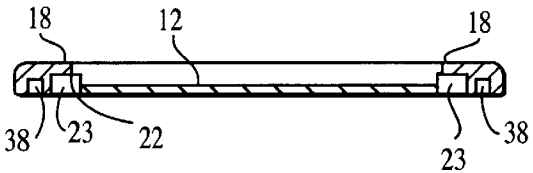
FIG. 3C is a section taken along line A—A.
Figure 3D:
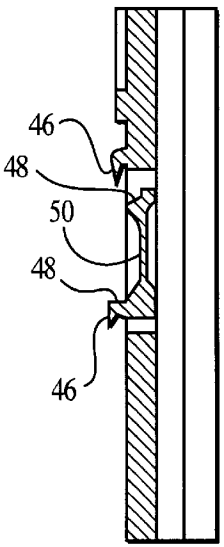
FIG. 3D is an enlarged section taken along line B—B.
Figure 3B:
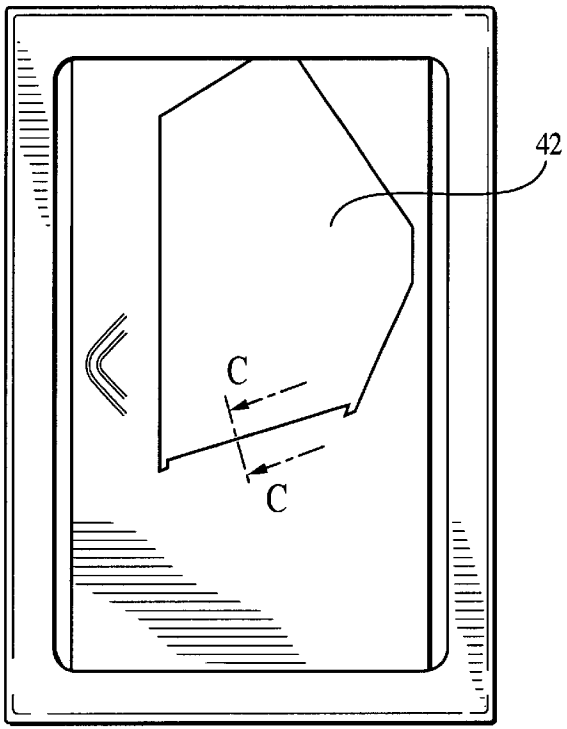
FIG. 3B is a front view of the FIG. 3A display frame.
Figure 3E:
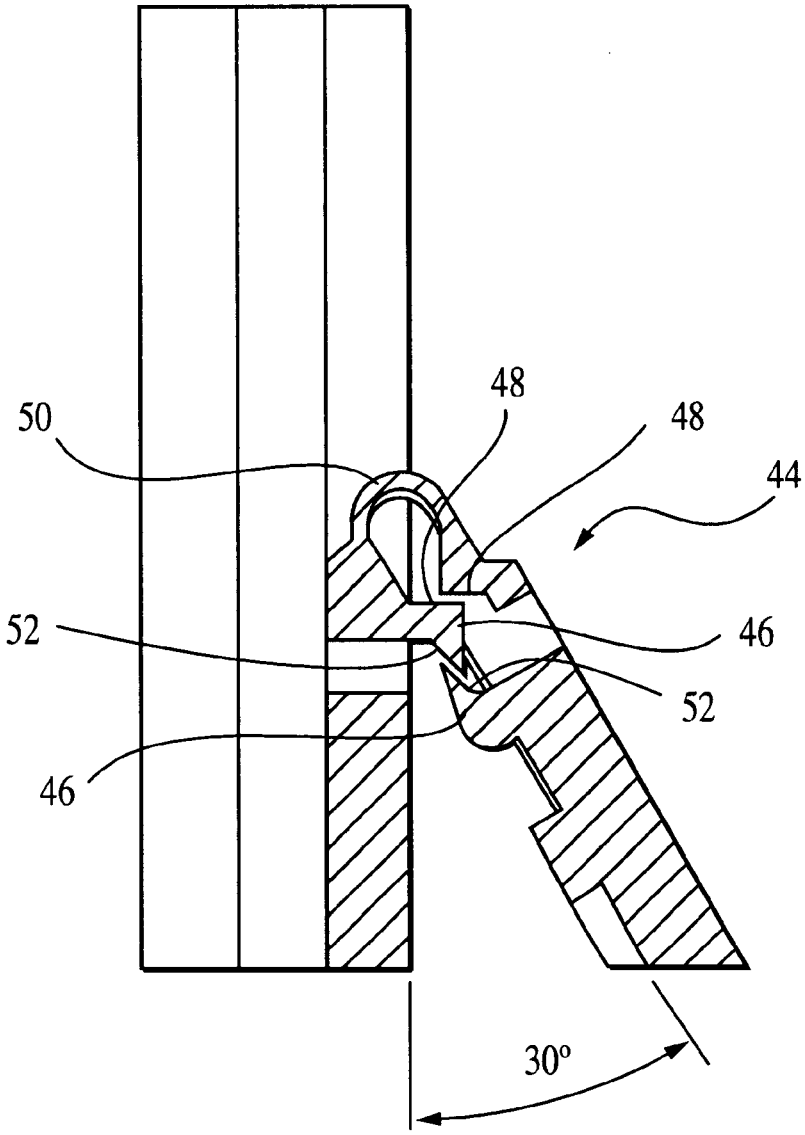
FIG. 3E is an enlarged section taken along line C—C.

The locking mechanism 44 permits the frame to free-stand at a predetermined angle. A preferred angle of 30° between the stand 42 and the frame presents the frame a traditional viewing angle. The locking mechanism 44 is best seen in FIGS. 3D and 3E, partial cross sections respectively taken along lines B—B and C—C. The locking mechanism 44 includes two teeth 46 and two shoulders 48. The teeth 46 lock together and the shoulders 48 abut when the stand 42 is rotated just past 150° about a hinge 50. The hinge 50 is a length of reduced thickness material. Its length is chosen to permit the required amount of rotation, e.g., the exemplary 150° of rotation. The teeth 46 and shoulders 48 are large enough to oppose the tendency of the stand to rotate back toward its position of 0° rotation, i.e., flush within the back portion 10 as seen in FIG. 3A and in the partial cross section B—B of FIG. 3D. Opposition of this tendency locks the stand into the preferred position of 30° from the bottom of the frame. Other sized and positioned teeth can obtain different angles, as will be appreciated by artisans. Preferably, the teeth 46 include angled surfaces 52. The angled surfaces 52 permit a user to apply force and obtain release of the stand 42 from the locked free-stand position. The stand 42 also includes ribs 54 to provide additional rigidity.

While specific embodiments of the present invention have been shown and described, it should be understood that other modifications, substitutions and alternatives are apparent to one of ordinary skill in the art. Such modifications, substitutions and alternatives can be made without departing from the spirit and scope of the invention, which should be determined from the appended claims.

Various features of the invention are set forth in the appended claims.

What is claimed is:

1. A molded plastic unibody display frame, formed from a single contiguous plastic piece, the piece being shaped into the frame comprising:

a backing portion including a flat surface defined in a first plane, said flat surface being shaped and sized to back thin and flat media of a predetermined size;

a framing portion extending from said backing portion and turned back toward said backing portion to define a media border, said border having a width to retain media of the predetermined size between said backing portion and a generally flat surface of said framing portion that is in a second plane generally parallel to said first plane;

an open slot defined between a limited length of said framing portion and said backing portion, said slot being sized to accept a sliding entry or exit of a media of the predetermined size;

an open viewing area within said media border to permit viewing of at least a substantial portion of media of the predetermined size;

a stand defined in said backing portion, being movable away from said backing portion while maintaining a hinged connection thereto;

wherein said stand and said backing portion include corresponding locking portions to lock said stand into an open position of a predetermined angle.

2. The frame of claim 1, wherein said stand rotates about said hinged connection approximately 150° to bring said corresponding locking portions together.

3. The frame of claim 1, wherein said locking portions comprise opposing teeth and abutting shoulders.

4. The frame of claim 3, wherein said opposing teeth include angled surfaces permitting a user to release said locking portions by applying force.

5. The frame of claim 4, further comprising structural ribs on said stand.

6. The frame of claim 1, wherein said stand is configured to support the frame in two different positions orthogonal to each other.

7. The frame of claim 1, further comprising a mounting aid molded into said backing portion.

8. The frame of claim 7, wherein said mounting aid comprises a magnet adhered to said backing portion on an opposite side from said flat surface defined in said first plane.

9. The frame of claim 7, wherein said mounting aid comprises hook and loop adhered to said backing portion on an opposite side from said flat surface defined in said first plane.

10. The frame of claim 7, wherein said mounting aid comprises an adhesive strip adhered to said backing portion on an opposite side from said flat surface defined in said first plane.

11. The frame of claim 1, further comprising a hanger defined in said backing portion, being movable away from said backing portion while maintaining a hinged connection thereto.

12. The frame of claim 1, further comprising a set of openings defined through said backing portion.

13. A molded plastic unibody display frame, formed from a single contiguous plastic piece, the piece being shaped into the frame comprising:

media channel portions for enclosing edges of a four sided media of a predetermined size on three sides, and having an open slot on a fourth side to accept sliding entry and exit of media of the predetermined size;

a framing portion sized to covered edge portions of a front surface of media of the predetermined size on all four sides of said media;

a backing portion to back a back surface of media of the predetermined size;

wherein the shape of said framing portion and said backing portion is configured to provide structural support for the frame;

a stand defined in said backing portion, being movable away from said backing portion while maintaining a hinged connection thereto;

wherein said stand and said backing portion include corresponding locking portions to lock said stand into an open position of a predetermined angle.

14. The frame of claim 13, wherein said stand is configured to support the frame in two different positions orthogonal to each other.

15. The frame of claim 13, wherein said stand rotates about said hinge approximately 150° to bring said corresponding locking portions together.

16. The frame of claim 13, wherein said locking portions comprise opposing teeth and abutting shoulders.

17. The frame of claim 16, wherein said opposing teeth include angled surfaces permitting a user to release said corresponding locking portions by applying force.

18. The frame of claim 17, further comprising structural ribs on said stand.

19. The frame of claim 13, further comprising a set of openings defined through said back portion.

20. A molded plastic unibody display frame, formed from a single contiguous plastic piece, the piece being shaped into the frame comprising:

a front media border;

a back media support;

media holding channels to hold four sided media of a predetermined size on three sides;

a slot to accept sliding entry and exit of media into said media holding channels;

a stand defined from material of said back media support being movable with respect to said back media support;

wherein said stand and said back media support include corresponding locking portions to lock said stand into an open position of a predetermined angle; and wherein said stand rotates approximately 150° about a hinge to bring said corresponding locking portions together.

21. The frame of claim 20, wherein said locking portions comprise opposing teeth and abutting shoulders.

22. The frame of claim 21, wherein said opposing teeth include angled surfaces permitting a user to release said locking portions by applying force.

23. The frame of claim 22, further comprising structural ribs on said stand.

24. The frame of claim 20, further comprising a set of openings defined through said back media support.

25. A molded plastic unibody display frame, formed from a single contiguous plastic piece, the piece being shaped into the frame comprising:

a backing portion including a flat surface defined in a first plane, said flat surface being shaped and sized to back thin and flat media of a predetermined size;

a framing portion extending from said backing portion and turned back toward said backing portion to define a media border, said border having a width to retain media of the predetermined size between said backing portion and a generally flat surface of said framing portion that is in a second plane generally parallel to said first plane;

an open slot defined between a limited length of said framing portion and said backing portion, said slot being sized to accept a sliding entry or exit of a media of the predetermined size;

an open viewing area within said media border to permit viewing of at least a substantial portion of media of the predetermined size;

a stand defined in said backing portion, being movable away from said backing portion while maintaining a hinged connection thereto; and a set of openings defined through said backing portion.

* * * * *